US009921513B2

(12) United States Patent
Masu et al.

(10) Patent No.: US 9,921,513 B2
(45) Date of Patent: Mar. 20, 2018

(54) CHARGING MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Hiroki Masu, Tokyo (JP); Noriyuki Doi, Numazu (JP); Kineo Takeno, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 250 days.

(21) Appl. No.: 14/956,862

(22) Filed: Dec. 2, 2015

(65) Prior Publication Data

US 2016/0161877 A1 Jun. 9, 2016

(30) Foreign Application Priority Data

Dec. 9, 2014 (JP) ..... 2014-249075

(51) Int. Cl.
*G03G 15/02* (2006.01)

(52) U.S. Cl.
CPC ..... *G03G 15/0233* (2013.01)

(58) Field of Classification Search
None
See application file for complete search history.

(56) References Cited

U.S. PATENT DOCUMENTS 6,168,908 B1 * 1/2001 Suzuki ..... G03F 7/00 430/271.1
8,503,911 B2 8/2013 Suzumura et al.
(Continued)

FOREIGN PATENT DOCUMENTS

CN 102656523 A 9/2012
CN 103124932 A 5/2013
(Continued)

OTHER PUBLICATIONS

U.S. Appl. No. 14/945,297, filed Nov. 18, 2015, Inventor(s): Kazuhiro Yamauchi et al.
(Continued)

*Primary Examiner* — Peter A Salamon
(74) *Attorney, Agent, or Firm* — Fitzpatrick Cella Harper and Scinto

(57) ABSTRACT

A charging member capable of inhibiting the effect of the contact mark on the electrophotographic image, even after in contact with another member for a long term, is provided. The charging member has a surface layer on a support, the surface layer containing a polymer compound having a structural unit represented by the following formula (1):

Formula (1)

In the formula (1), A represents an aromatic cyclic hydrocarbon group; $R_1$ represents a specific hydrocarbon group. L represents a polysiloxane having at least one of an $SiO_{3/2}$ unit (T) and an $SiO_{2/2}$ unit (D). U represents an integer of 1 or more.

5 Claims, 2 Drawing Sheets

(56) References Cited

U.S. PATENT DOCUMENTS

| | | | | |
|---|---|---|---|---|
| 8,526,857 | B2 | 9/2013 | Tomomizu et al. | |
| 2007/0042296 | A1* | 2/2007 | Sasaki | G03F 7/0226 430/281.1 |
| 2011/0182617 | A1 | 7/2011 | Kuruma et al. | |
| 2012/0141160 | A1 | 6/2012 | Tomomizu et al. | |
| 2012/0148306 | A1 | 6/2012 | Tomomizu et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2013/0295330 | A1* | 11/2013 | Kodama | G03G 15/02 428/147 |
| 2014/0004258 | A1* | 1/2014 | Suzumura | G03G 15/02 427/126.1 |
| 2014/0072343 | A1* | 3/2014 | Masu | G03G 15/0233 399/176 |
| 2014/0080691 | A1* | 3/2014 | Kurachi | G03G 15/0233 492/18 |
| 2015/0331348 | A1 | 11/2015 | Doi et al. | |

FOREIGN PATENT DOCUMENTS

| | | | |
|---|---|---|---|
| CN | 103124934 | A | 5/2013 |
| JP | 2894508 | B2 | 5/1999 |
| JP | 2001-173641 | A | 6/2001 |

OTHER PUBLICATIONS

U.S. Appl. No. 14/943,774, filed Nov. 17, 2015, Inventor(s): Satoru Nishioka et al.

U.S. Appl. No. 14/946,768, filed Nov. 19, 2015, Inventor(s): Hiroki Masu et al.

U.S. Appl. No. 14/945,314, filed Nov. 18, 2015, Inventor(s): Kazuhiro Yamauchi et al.

* cited by examiner

CHARGING MEMBER, PROCESS CARTRIDGE, AND ELECTROPHOTOGRAPHIC APPARATUS

BACKGROUND OF THE INVENTION

Field of the Invention

The present invention relates to a charging member, a process cartridge, and electrophotographic apparatus.

Description of the Related Art

At the present time, a contact charging method is one of the method for charging the surface of an electrophotographic photosensitive member. In the contact charging method, a DC voltage or a DC-AC superimposed voltage is applied to a charging member disposed in contact with or adjacent to an electrophotographic photosensitive member, and a micro discharge between the charging member and the electrophotographic photosensitive member is caused to charge the surface of the electrophotographic photosensitive member.

The structure of a charging member for use in a contact charging method typically includes a support and an electro-conductive elastic layer disposed on the support, from the viewpoint of sufficiently securing a nip between a charging member and an electrophotographic photosensitive member. In order to prevent the adhesion of toner and the like to the surface of a charging member, and in order to prevent low molecular weight components contained in the electro-conductive elastic layer from bleeding to the surface of the charging member, a surface layer is typically disposed on the surface of the electro-conductive elastic layer.

Japanese Patent No. 2894508 discloses that a hydroxystyrene resin-containing resin layer disposed on an electro-conductive elastic layer can prevent fusing between a charging layer and an electrophotographic photosensitive member and contamination of a charging member with toner. And Japanese Patent Application Laid-Open No. 2001-173641 discloses a charging roll having an electro-conductive elastic layer with the circumferential surface coated with an organic-inorganic hybrid coating film, which prevents low molecular weight components from bleeding to the surface.

The present invention is directed to providing a charging member capable of inhibiting the effect of the contact mark on the electrophotographic image, even after in contact with another member for a long term.

The present invention is also directed to providing a process cartridge and an electrophotographic apparatus capable of stably forming a high quality electrophotographic image.

SUMMARY OF THE INVENTION

According to an aspect of the present invention, a charging member having a support and a surface layer thereon is provided, in which the surface layer contains a polymer compound having a structural unit represented by the following formula (1).

Formula (1)

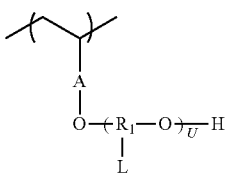

In the formula (1), A represents an aromatic cyclic hydrocarbon group. $R_1$ represents any one of the following formulae (2) to (5). L represents a polysiloxane having at least one of an $SiO_{3/2}$ unit (T) and an $SiO_{2/2}$ unit (D). U represents an integer of 1 or more. In the case that U is an integer of 2 or more, a plurality of $R_1$ are present, $R_1$ each independently represent any one of the following formulae (2) to (5).

Formula (2)

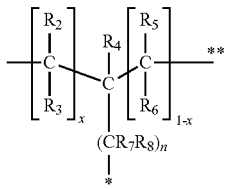

Formula (3)

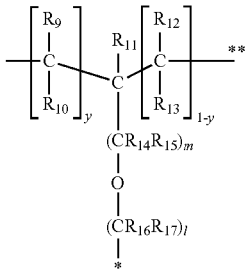

Formula (4)

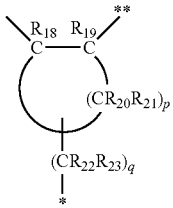

Formula (5)

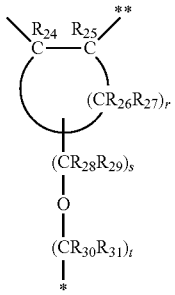

In the formulae (2) to (5), $R_2$ to $R_6$, $R_9$ to $R_{13}$, $R_{18}$, $R_{19}$, $R_{24}$ and $R_{25}$ each independently represent a hydrogen atom, an alkyl group having 1 to 4 carbon atoms, a hydroxyl group, a carboxyl group or an amino group. $R_7$, $R_8$, $R_{14}$ to $R_{87}$, $R_{22}$, $R_{23}$, and $R_{28}$ to $R_{31}$ each independently represent a hydrogen atom or an alkyl group having 1 to 4 carbon atoms. $R_{20}$, $R_{21}$, $R_{26}$ and $R_{27}$ each independently represent a hydrogen atom, an alkoxy group or alkyl group having 1 to 4 carbon atoms. Herein, n, m, l, q, s and t each independently represent an integer of 1 to 8. Herein, p and r each independently represent an integer of 4 to 12. Herein, x and y each independently represent 0 or 1. Herein, the symbol * represents the binding site with a silicon atom in a polysiloxane represented by L in the formula (1). Herein, the symbol ** represents the binding site with an oxygen atom in a unit represented by —($R_1$(L)-O)— in the formula (1).

In another aspect of the present invention, a process cartridge which is detachably mountable to a body of an electrophotographic apparatus is provided, having an electrophotographic photosensitive member and a charging member for charging the surface of the electrophotographic photosensitive member, in which the charging member is the charging member described above.

In yet another aspect of the present invention, an electrophotographic apparatus is provided, having an electrophotographic photosensitive member and a charging member for charging the surface of the electrophotographic photosensitive member, in which the charging member is the charging member described above.

Advantageous Effects of Invention

According to the present invention, a charging member capable of inhibiting the effect of the mark of the contact part on an electrophotographic image, i.e. eliminating the effects or effectively reducing the effect, even after in contact with another member for a long term, can be obtained. Further, according to the present invention, a process cartridge and an electrophotographic apparatus can be obtained, allowing a high quality electrophotographic image to be stably formed.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to the investigation of the present inventors, when the charging member described in Japanese Patent No. 2894508 or in Japanese Patent Application Laid-Open No. 2001-173641 was used for forming an electrophotographic image after in contact with an electrophotographic photosensitive member in a resting state for a long period, the contact mark between the charging member and the electrophotographic photosensitive member appeared as density irregularities in a streak form in an electrophotographic image, in some cases.

It is known that a charging member for use in contact charging in contact with another member for a long period is deformed at the contact part and hardly restored, causing permanent compressive deformation. It is presumed that due to the difference in charging ability between the part with permanent compressive deformation and the part without permanent compressive deformation of a charging member, density irregularities in a streak form are caused in an electrophotographic image corresponding to the part with permanent compressive deformation of the charging member. In the charging member having an organic-inorganic hybrid coating film described in Japanese Patent Application Laid-Open No. 2001-173641, it is conceivable that the bleeding substances appeared on the surface as a result of insufficient inhibition of bleeding of low molecular weight components to the surface also contribute to the density irregularities in a streak form. It is presumed that the density irregularities are caused due to the small cross-linking density of the organic-inorganic hybrid coating film, as a result of setting a high value on the flexibility.

As a result of investigation by the present inventors based on the technical background described above, an invention of a charging member capable of inhibiting the effect of the contact mark on the electrophotographic image even after in contact with another member for a long term has been made.

Figure 1:
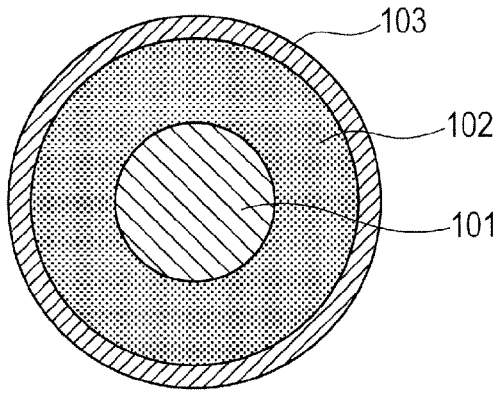
FIG. 1 is a cross-sectional view illustrating one example of the charging member of the present invention.

The charging member of the present invention has at least a support and a surface layer disposed on the support. An elastic layer may be disposed between the support and the surface layer. Although the simplest structure of the charging member includes two layers consisting of the elastic layer and the surface layer on the support, one or more layers may be disposed between the support and the elastic layer or between the elastic layer and the surface layer. In FIG. 1 illustrating the cross section orthogonal to the central axis of a charging roller in a roller form as typical example of a charging member, the charging member has a structure including an elastic layer 102 and a surface layer 103 laminated in this order on the circumferential surface of a cylindrical support 101.

<Support>

The support has electro-conductivity and has a function to support the surface layer and the like to be disposed thereon. The shape of the support may be appropriately selected corresponding to the shape of the charging member. Specific examples of the material to compose the support include the following:

a support formed of metal (alloy) such as iron, copper, stainless steel, aluminum, aluminum alloy, and nickel.

Alternatively, a support formed of resin reinforced with electro-conductive filler may be used.

<Elastic Layer>

As the material to form an elastic layer, one or a plurality of elastic material such as rubber for use in the elastic layer or the electro-conductive elastic layer of a conventional charging member may be used.

Examples of the rubber include the following: an urethane rubber, a silicone rubber, a butadiene rubber, an isoprene rubber, a chloroprene rubber, a styrene-butadiene rubber, an ethylene-propylene rubber, a polynorbornene rubber, a styrene-butadiene-styrene rubber, an acrylonitrile rubber, an epichlorohydrin rubber, and an alkyl ether rubber.

The elastic layer may appropriately include an electro-conductive material, so that the electro-conductivity can be adjusted to a prescribed value. The electrical resistance of an elastic layer may be adjusted by appropriately selecting the type and the amount of the electro-conductive material for use. The electrical resistance is preferably in the range of $10^{2}\Omega$ or more and $10^{8}\Omega$ or less, more preferably in the range of $10^{3}\Omega$ or more and $10^{6}\Omega$ or less.

Examples of the electro-conductive material for use in the elastic layer include a carbon material, a metal oxide, a metal, a cationic surfactant, an anionic surfactant, an amphoteric surfactant, an antistatic agent, and an electrolyte. A plurality thereof may be used in combination on an as needed basis.

Specific examples of the carbon material include electro-conductive carbon black and graphite.

Specific examples of the metal oxide include tin oxide, titanium oxide, and zinc oxide.

Specific examples of the metal include nickel, copper, silver, and germanium.

Specific examples of the cationic surfactant include a quaternary ammonium salt (e.g. lauryltrimethylammonium, stearyltrimethylammonium, octadodecyltrimethylammonium, dodecyltrimethylammonium, hexadecyltrimethylammonium, and modified fatty acid-dimethylethylammonium), perchlorate, chlorate, a fluoroboric acid salt, an ethosulfate salt, and a benzylhalide salt (a benzylbromide salt, a benzylchloride salt, etc.).

Specific examples of the anionic surfactant include an aliphatic sulfonate, a higher alcohol sulfate, a higher alcohol ethylene oxide adduct sulfate, a higher alcohol phosphate, and a higher alcohol ethylene oxide adduct phosphate.

Specific examples of the amphoteric surfactant include N-alkylaminopropionic acid, N-alkylbetaine, and dimethylalkylamine oxide.

Examples of the antistatic agent include a nonionic antistatic agent such as a higher alcohol ethylene oxide, a polyethylene glycol fatty acid ester, and a polyalcohol fatty acid ester.

Examples of the electrolyte include a salt of the metal (e.g. Li, Na, K, etc.) in the first group in the periodic table. Specific examples of the salt of a metal in the first group in the periodic table include $LiCF_3SO_3$, $NaClO_4$, $LiAsF_6$, $LiBF_4$, NaSCN, KSCN and NaCl.

The hardness of the elastic layer can be 60 degrees or more and 85 degrees or less in MD-1 hardness, from the viewpoint of inhibiting deformation of the charging member when the charging member and the electrophotographic photosensitive member (hereinafter also referred to as simply photosensitive member) as a body to be charged are contacted. The elastic layer can be in a so-called crown shape having a thicker layer thickness at the central part than the layer thickness at the end so as to make a uniform contact with the photosensitive member in the width direction.

<Surface Layer>

The surface layer of the present invention includes a polymer compound having a structural unit represented by the following formula (1).

Formula (1)

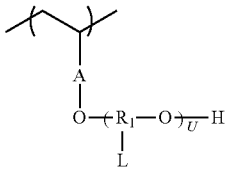

In the formula (1), A represents an aromatic cyclic hydrocarbon group. $R_1$ represents any one of the following formulae (2) to (5). L represents a polysiloxane having at least an $SiO_{3/2}$ unit (T) and/or an $SiO_{2/2}$ unit (D). U represents an integer of 1 or more. In the case of U of 2 or more, namely when a plurality of $R_1$ are contained, $R_1$ each independently represent any one of the following formulae (2) to (5).

L is a polysiloxane having a unit (T) represented by a molecular formula $SiO_{3/2}$ and/or a unit (D) represented by a molecular formula $SiO_{2/2}$, and can include at least a unit (T), i.e. $SiO_{3/2}$, which can have three-dimensional cross-linking structure, from the viewpoint of improving elasticity and inhabiting bleeding.

Formula (2)

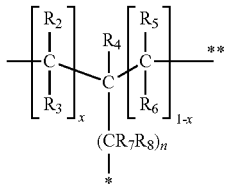

Formula (3)

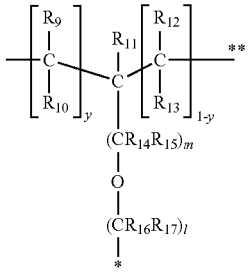

Formula (4)

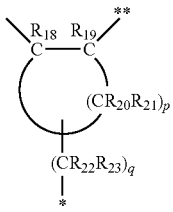

Formula (5)

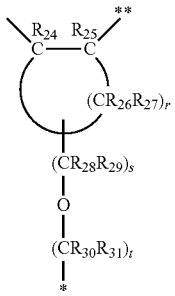

In the formulae (2) to (5), $R_2$ to $R_6$, $R_9$ to $R_{13}$, $R_{18}$, $R_{19}$, $R_{24}$ and $R_{25}$ each independently represent a hydrogen atom, an alkyl group having 1 to 4 carbon atoms, a hydroxyl group, a carboxyl group or an amino group. $R_7$, $R_8$, $R_{14}$ to $R_{17}$, $R_{22}$, $R_{23}$, and $R_{28}$ to $R_{31}$ each independently represent a hydrogen atom or an alkyl group having 1 to 4 carbon atoms. $R_{20}$, $R_{21}$, $R_{26}$ and $R_{27}$ each independently represent a hydrogen atom, an alkoxy group or alkyl group having 1 to 4 carbon atoms. Herein, n, m, l, q, s and t each independently represent an integer of 1 to 8. Herein, p and r each independently represent an integer of 4 to 12. Herein, x and y each independently represent 0 or 1. Herein, the symbol * represents the binding site with a silicon atom in a polysiloxane represented by L in the formula (1). Herein, the symbol ** represents the binding site with an oxygen atom in a unit represented by —($R_1$(L)-O)— in the formula (1).

$R_1$ can be any one selected from the structures represented by the following general formulae (6) to (9). In this case, the presence of an organic chain allows the modulus of elasticity of the surface layer or the film properties such as the fragility and the flexibility of the surface layer to be controlled. The presence of the organic chain, in particular, ether region in the organic chain structure improves the adhesion of the surface layer to the elastic layer.

Formula (6)

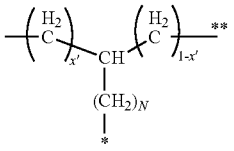

Formula (7)

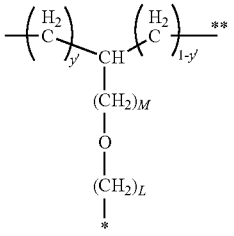

Formula (8)

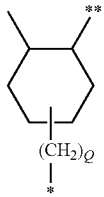

Formula (9)

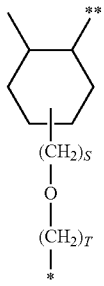

In the formulae (6) to (9), N, M, L, Q, S and T each independently can be an integer of 1 to 8 from the viewpoints of easy availability and the easy control of the modulus of elasticity and the film properties such as fragility and flexibility of the surface layer. Herein, x and y' each independently represent 0 or 1. Herein, the symbol * represents the binding site with a silicon atom in polysiloxane represented by L in the formula (1). Herein the symbol ** represents the binding site with an oxygen atom in the unit represented by —($R_1$(L)-O)— in the formula (1). In the present invention, the structure represented by the formula (1) includes the following structures.

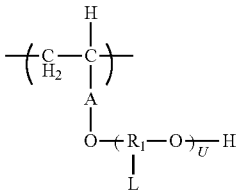

-continued

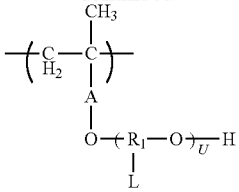

As an example of the polymer compound of the present invention, a part of the structure of the polymer compound is illustrated as follows, in which $R_1$ in the formula (1) is a structure represented by the formula (2), and L is a polysiloxane having an $SiO_{3/2}$ unit (T).

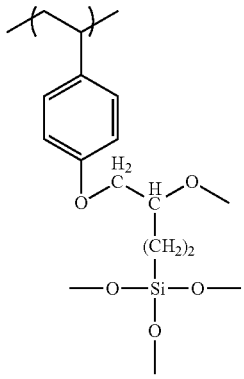

The polymer compound having the structural unit represented by the formula (1) can be a reaction product of a compound having a structure represented by the following formula (10) and at least one of a hydrolysable compound represented by the following formula (11) and a hydrolysable compound represented by the following formula (12). The modulus of elasticity and the compactness of the surface layer are controlled through control of the degrees of hydrolysis and the condensation occurring at the three functional sites of the general formula (11) and the two functional sites of the general formula (12), so that bleeding from the elastic layer can be controlled. Further, the modulus of elasticity of the surface layer can be controlled by $R_{32}$ in the general formula (11) and $R_{36}$ in the general formula (12) formed of an organic group having an epoxy group reactive with the hydroxyl group in the general formula (10).

Formula (10)

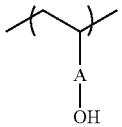

Formula (11)

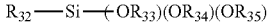

Formula (12)

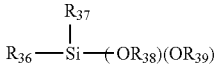

In the general formula (10), A represents an aromatic cyclic hydrocarbon group. $R_{32}$ in the general formula (11) and $R_{36}$ in the general formula (12) represent any one of the following formulae (13) to (16) having an epoxy group. $R_{33}$ to $R_{35}$ in the general formula (11) and $R_{38}$ and $R_{39}$ in the general formula (12) each independently represent a hydrocarbon group. $R_{37}$ in the general formula (12) represents a saturated or unsaturated monovalent hydrocarbon group.

Formula (13)

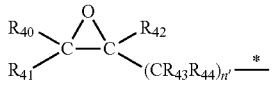

Formula (14)

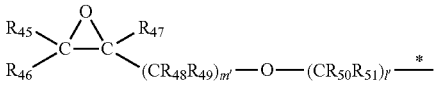

Formula (15)

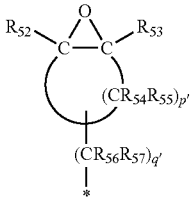

Formula (16)

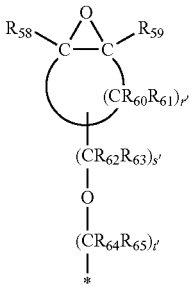

In the formulae (13) to (16), $R_{40}$ to $R_{42}$, $R_{45}$ to $R_{47}$, $R_{52}$, $R_{53}$, $R_{58}$ and $R_{59}$ each independently represent a hydrogen atom, an alkyl group having 1 to 4 carbon atoms, a hydroxyl group, a carboxyl group or an amino group. $R_{43}$, $R_{44}$, $R_{48}$ to $R_{51}$, $R_{56}$, $R_{57}$, and $R_{62}$ to $R_{65}$ each independently represent a hydrogen atom or an alkyl group having 1 to 4 carbon atoms. $R_{54}$, $R_{55}$, $R_{60}$ and $R_{61}$ each independently represent a hydrogen atom, an alkoxy group having 1 to 4 carbon atoms or an alkyl group having 1 to 4 carbon atoms.

Herein, n', m', l', q', s' and t' each independently represent an integer of 1 to 8. Herein, p' and r' each independently represent an integer of 4 to 12. Herein, the symbol * represents the binding site with a silicon atom in the formula (11) or the formula (12).

In the reaction of a compound having a structure represented by the general formula (10) with a hydrolysable silane compound represented by the general formula (11) and/or the general formula (12), the blending mass ratio (10)/((11)+(12)) at the reaction time can be 1/9 or more and 9/1 or less from the viewpoints of improving the film formability, the modulus of elasticity, and the compactness of the surface layer.

Examples of the compound having the structure represented by the general formula (10) include a polymer having hydroxystyrene as polymerizable component, a polymer having α-methylhydroxystyrene as polymerizable component, and a copolymer having hydroxystyrene and α-methylhydroxystyrene as polymerizable components. More specific examples thereof include polyvinylphenol (polyhydroxystyrene) and a copolymer thereof, and a halide of polyvinylphenol and a copolymer thereof.

Examples of the hydrocarbon group as $R_{33}$ to $R_{35}$ in the general formula (11) and as $R_{38}$ and $R_{39}$ in the general formula (12) include an alkyl group, an alkenyl group, and an aryl group. Among them, a straight chain or branched chain alkyl group having 1 to 4 carbon atoms is preferred, and a methyl group, an ethyl group, an n-propyl group, an i-propyl group, an n-butyl group, and a t-butyl group are more preferred.

Examples of the saturated or unsaturated monovalent hydrocarbon group as $R_{37}$ in the general formula (12) include an alkyl group, an alkenyl group, and aryl group. Among them, a straight chain or branched chain alkyl group having 1 to 3 carbon atoms is preferred, and a methyl group and an ethyl group are more preferred.

Specific examples of the hydrolysable silane compound having the structure represented by the general formula (13) and the structure represented by the general formula (11) or (12) are as follows: 4-(1,2-epoxybutyl)trimethoxysilane, 4-(1,2-epoxybutyl)triethoxysilane, 4-(1,2-epoxybutyl)methyldimethoxysilane, 4-(1,2-epoxybutyl)methyldiethoxysilane, 5,6-epoxyhexyltrimethoxysilane, 5,6-epoxyhexyltriethoxysilane, 5,6-epoxyhexylmethyldimethoxysilane, 5,6-epoxyhexylmethyldiethoxysilane, 8-oxysilane-2-yloctyltrimethoxysilane, and 8-oxysilane-2-yloctyltriethoxysilane.

Specific examples of the hydrolysable silane compound represented by the general formula (11) or (12), having the structure represented by the general formula (14), are as follows: glycidoxypropyltrimethoxysilane, glycidoxypropyltriethoxysilane, glycidoxypropylmethyldimethoxysilane, and glycidoxypropylmethyldiethoxysilane.

Specific examples of the hydrolysable silane compound represented by the general formula (11) or (12), having the structure represented by the general formula (15), are as follows: 2-(3,4-epoxycyclohexyl)ethyltrimethoxysilane, 2-(3,4-epoxycyclohexyl)ethyltriethoxysilane, 2-(3,4-epoxycyclohexyl)ethylmethyldimethoxysilane, and 2-(3,4-epoxycyclohexyl)ethylmethyldiethoxysilane.

Specific examples of the hydrolysable silane compound represented by the general formula (11) or (12), having the structure represented by the general formula (16), are as follows: 3-(3,4-epoxycyclohexyl)methyloxypropyltrimethoxysilane, 3-(3,4-epoxycyclohexyl)methyloxypropyltriethoxysilane, 3-(3,4-epoxycyclohexyl)methyloxypropylmethyldimethoxysilane, and 3-(3,4-epoxycyclohexyl)methyloxypropylmethyldiethoxysilane.

<Manufacturing Method of Charging Member>

The surface layer of the charging member of the present invention can be formed by applying a coating liquid containing the material for forming the surface layer on the support or on the elastic layer so as to make a coating layer, which is to be solidified by drying or the like.

The coating liquid can be obtained by mixing a compound having the structure represented by the general formula (10) with a hydrolysable compound represented by the general formula (11) and/or the general formula (12) in an organic solvent, and heating the mixture to proceed the reaction.

The organic solvent for use is not particularly limited as long as the solvent can dissolve the compound having the structure represented by the general formula (10) and the hydrolysable compound represented by the general formula (11) and/or the general formula (12). Examples of the solvent for use include an alcohol solvent, an ether solvent, a cellosolve solvent, a ketone solvent, and an ester solvent.

Specific examples of the alcohol solvent include methanol, ethanol, n-propanol, isopropanol, 1-butanol, 2-butanol, t-butanol, 1-pentanol, and cyclohexanol.

Specific examples of the ether solvent include dimethoxyethane.

Specific examples of the cellosolve solvent include methyl cellosolve and ethyl cellosolve.

Specific examples of the ketone solvent include acetone, methyl ethyl ketone, and methyl iso-butyl ketone.

Specific examples of the ester solvent include methyl acetate and ethyl acetate.

The organic solvent may be used alone, or a mixture of the two or more kinds may be used.

The occurrence of a reaction between the compound having a structure represented by the general formula (10) and the hydrolysable compound represented by the general formula (11) or a reaction between the compound having a structure represented by the general formula (10) and the hydrolysable compound represented by the general formula (12), can be confirmed by NMR analysis.

Subsequently, the obtained coating liquid is adjusted to a proper concentration, which is then applied on the support or on the electro-conductive elastic layer so as to form a surface layer. The method for forming the surface layer is not particularly limited, and a conventional method can be selected. Specific examples of the method include roll coater coating, immersion coating, and ring coating.

After formation of the surface layer, heating treatment may be performed to dry the solvent or to accelerate the hydrolysis and condensation of the hydrolysable compound represented by the general formula (11).

The physical properties such as the dynamic friction coefficient and the surface free energy of the charging member having the surface layer of the present invention can be adjusted by heat treatment of the surface layer. More specifically, a method of irradiating an active energy rays is commonly-used for heat treatment. Examples of the active energy rays include ultra violet rays, infrared rays, and electron rays.

A thickness of the surface layer only as a guide is preferably 10 nm or more and 1000 nm or less, particularly preferably 50 nm or more and 500 nm or less, from the viewpoints of the charging capability and the prevention of bleeding of low molecular weight component from the elastic layer when provided.

<Electrophotographic Apparatus>

Figure 2:
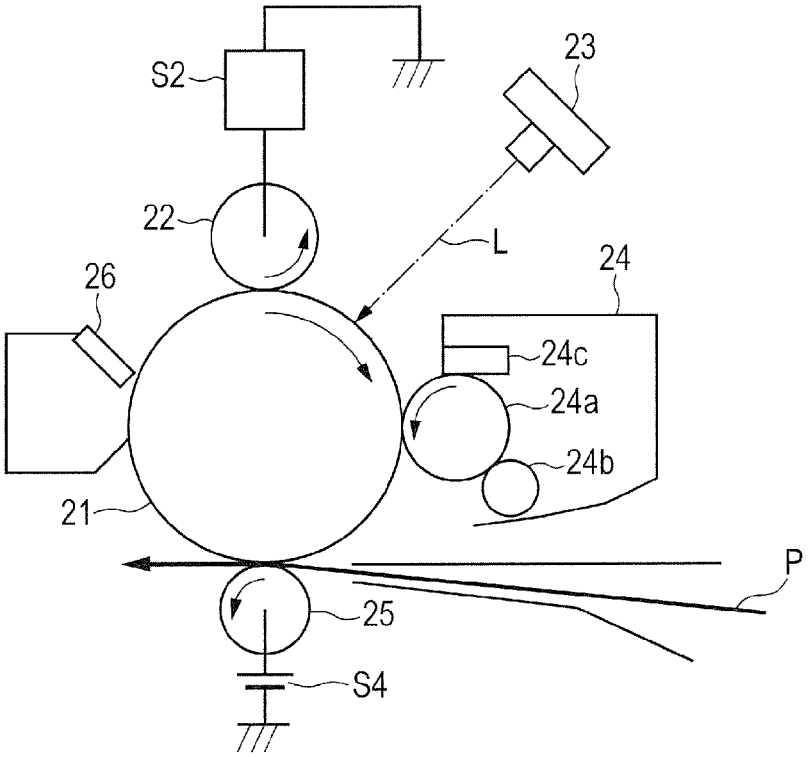
FIG. 2 is a cross-sectional view of an electrophotographic apparatus having the process cartridge of the present invention, illustrating the structure in an embodiment.

In FIG. 2, an example of the schematic structure of an electrophotographic apparatus having the charging member of the present invention is illustrated.

The electrophotographic apparatus includes at least a rotary drum-type electrophotographic photosensitive member (photosensitive member) 21 as an image bearing member for bearing a toner image and a static latent image, and a charging roller 22 as the charging member of the present invention.

The photosensitive member 21 is rotary driven at a predetermined circumferential rate (process speed) in the clockwise direction as indicated by arrow in the drawing.

A charging roller 22, and a charging bias applying power source S2 for applying charging bias to the charging roller 22 compose a charging device. The charging roller 22 in contact with the photosensitive member 21 at a prescribed pressing force is rotary driven in the forward direction (anticlockwise direction in FIG. 2) relative to the rotation of the photosensitive member 21. A prescribed DC voltage (−1140 V in the following Example) is applied, from the charging bias applying power source S2, to the charging roller 22 (DC charging method), so that the surface of the photosensitive member 21 is uniformly charged at a prescribed polar potential (dark part potential: −500 V, in the following Example).

At the downstream of the charging roller 22 in the rotation direction (clockwise direction in FIG. 2) around the axis of the photosensitive member 21, an exposure device 23 is disposed. A known device may be used as the exposure device 23, and, for example, a laser beam scanner can be used. Exposure light L such as laser light is emitted from the exposure device 23.

On the charged surface of the photosensitive member 21, image exposure corresponding to an objective image data is performed by the exposure device 23, so that the potential at an exposed bright part on the charged surface of the photosensitive member (bright part potential: −150 V, in the following Example) is selectively lowered (attenuated). Consequently a static latent image is formed on the photosensitive member 21.

At the downstream of the irradiation position of the exposure light L in the rotation direction (clockwise direction in FIG. 2) around the axis of the photosensitive member 21, a developing device 24 for reversal developing of the static latent image is disposed. A known device may be used as the developing device 24. The developing device includes a toner bearing member 24*a* for bearing and carrying the toner, disposed at the opening of a developing container for accommodating toner. The developing device 24 further includes an agitation member 24*b* for agitating the accommodated toner, and a toner regulating member 24*c* for regulating the amount of toner (toner layer thickness) borne on the toner bearing member 24*a*. The developing device 24 allows the toner (negatively chargeable toner) charged to the same polarity as the charging polarity of the photosensitive member 21 to selectively adhere to the exposed bright part of the static latent image on the surface of the photosensitive member 21 so as to visualize the static latent image as a toner image (developing bias: −400V, in the following Example). The developing method is not particularly limited, and can be selected from all of the existing developing methods, such as a jumping developing method, a contact developing method and a magnetic brush method. At the downstream of the developing device 24 in the rotation direction (clockwise direction in FIG. 2) around the axis of the photosensitive member 21, a transfer roller 25 is disposed as transfer device. A known device may be used as the transfer roller 25. Examples thereof include a transfer roller including an electro-conductive support made of metal or the like coated with an elastic resin layer prepared to have a medium resistance. The transfer roller 25 in contact with the photosensitive member 21 at a prescribed pressing force is rotated in the forward direction (anticlockwise direction in FIG. 2) relative to the rotation of the photosensitive member 21 at approximately the same circumferential speed as the rotational circumferential speed of the photosensitive member 21. A transfer voltage in a reverse polarity of the charging properties of the toner is applied from a transfer bias applying power source S4. To the contact part between the photosensitive member 21 and the transfer roller 25, a transfer medium P is fed at a prescribed timing from a paper feed mechanism not illustrated in drawing, and the rear face of the transfer medium P is charged to a reverse polarity of the charging polarity of the toner with the transfer roller 25 applied with a transfer voltage. At the contact part between the photosensitive member 21 and the transfer roller 25, the toner image on the side of the photosensitive member 21 is thereby electrostatically transferred on the front face side of the transfer medium P.

The transfer medium P having the transferred toner image is separated from the surface of the photosensitive member, introduced into a toner image fixation device not illustrated in drawing for fixation of the toner image, and outputted as an image-formed object. In a both-side image forming mode or a multiple image forming mode, the image-formed object is introduced in a recirculating transport mechanism not illustrated in drawing for re-introduction to the transfer part. The residue on the photosensitive member 21 such as transfer residual toner is collected from on the photosensitive member 21 with a cleaning device 26 of blade type or the like. When the residual charge remains on the photosensitive member 21, the residual charge on the photosensitive member 21 should be removed with a pre-exposure device (not illustrated in drawing) prior to primary charging with the charging member 22 after transfer. In the following Example, no pre-exposure device was used in image forming.

At least the charging member 22 and the photosensitive member 21 can be integrally supported in a process cartridge which can be detachably mountable in a body of an electrophotographic apparatus. Into the process cartridge, the developing device 24 and/or the cleaning device 26 may be added besides the charging member 22 and the photosensitive member 21. In the following Example, a process cartridge for use integrally supports the charging member 22, the photosensitive member 21, the developing device 24, and the cleaning device 26.

EXAMPLE

The present invention is described in more detail below with reference to Examples. In the specification, "part" means "part by mass".

<Preparation of Roller Having Elastic Layer>

The materials each described in Table 1 were kneaded with a 6-L pressure kneader (apparatus for use: TD6-15MDX, manufactured by Toshin Co., Ltd.) for 20 minutes. Subsequently 4.5 parts of tetrabenzylthiuram disulfide (product name: SANCELER TBzTD, manufactured by Sanshin Chemical Industry Co., Ltd.) as vulcanization accelerator and 1.2 parts of sulfur as vulcanizing agent were further added to the kneaded product. The mixture thus obtained was further kneaded with an open roll having a roll diameter of 12 inches for 8 minutes, so that an unvulcanized rubber composition was obtained.

TABLE 1

| Raw material | Amount used |
|---|---|
| Medium high nitrile NBR [product name: NIPOL DN219, combined acrylonitrile amount: 33.5% (median), Mooney viscosity: 27 (median), manufactured by Zeon Corporation] | 100 Parts |
| Carbon black for color (filler) [product name: #7360SB, particle diameter: 28 nm, nitrogen adsorption specific surface area: 77 $m^2/g$, DBP adsorption amount: 87 $cm^3/100$ g, manufactured by Tokai Carbon Co., Ltd.] | 48 Parts |
| Calcium carbonate (filler) [product name: NANOX #30, manufactured by Maruo Calcium Co., Ltd.] | 20 Parts |
| Zinc oxide | 5 Parts |
| Zinc stearate | 1 Parts |

Subsequently, a thermosetting adhesive which contains metal and rubber (product name: METALOC N-33, manufactured by Toyokagaku Kenkyusho Co., Ltd.) was applied to a steel substrate in a cylindrical shape with a diameter of 6 mm and a length of 252 mm (having a nickel plated surface). The application region extends 115.5 mm in the axial direction of the cylindrical surface from the center to both ends (total width of the region: 231 mm in the axial direction). The coated substrate was dried at 80° C. for 30 minutes, and further dried at 120° C. for 1 hour, so that an adhesive layer was formed on the support.

Subsequently, using a cross head extruder, an unvulcanized rubber composition was coaxially extruded to form a cylindrical shape with an outer diameter of 8.75 to 8.90 mm on the support coated with the adhesive layer. Both ends were cut off, so that an unvulcanized rubber composition layer (length: 242 mm) was formed on the outer circumference of the support. A roller coated with the unvulcanized rubber composition layer was thus obtained. The extruder for use had a cylinder diameter of 70 mm, and a ratio L/D of 20. The temperature conditions during extrusion were as follows: head temperature: 90° C., cylinder temperature: 90° C., and screw temperature: 90° C.

Subsequently, the thus obtained roller coated with the unvulcanized rubber composition layer was subjected to vulcanization of the unvulcanized rubber composition layer, using a continuous heating furnace having two zones with different temperature settings. More specifically, a first zone was set to a temperature of 80° C. for the roller passing through for 30 minutes, and a second zone was set to a temperature of 160° C. for the roller passing through for 30 minutes, so that the unvulcanized rubber composition layer was vulcanized to form an elastic layer. Subsequently, both ends of the elastic layer were cut off, so that the elastic layer had a width of 232 mm in the axial direction. The surface of the elastic layer was then polished with a grinding wheel. An electro-conductive elastic roller 1 was thus obtained, having a crown shape with a diameter of 8.26 mm at ends and a diameter of 8.50 mm at the center, a 10-point average roughness Rz of the surface of 5.5 μm, a deviation of 18 μm, and an MD-1 hardness of 73 degrees.

The 10-point average roughness Rz was measured according to JIS B 0601 (1994). The deviation was measured with a high-accuracy laser measuring machine LSM-430V manufactured by Mitutoyo Corporation. To be more specific, the outer diameter was measured with the measuring machine, and the difference between the maximum outer diameter and the minimum outer diameter was obtained as the outer diameter difference deviation at 5 points. The average of the outer diameter difference deviations at 5 points was presumed as the deviation of the measured object.

<Preparation of Coating Liquid and Formation of Surface Layer>

The list of the polymers for use is described in Table 2, and the list of the hydrolysable compounds for use is described in Table 3.

(Example 1) Charging Roller E1

In a 50-mL glass container, 10.0 g of dimethoxyethane (DME), 5.0 g of polyvinylphenol (PVP-1, manufactured by Sigma-Aldrich), and 5.0 g of 3-glycidoxypropyltrimethoxysilane (EP-1) were placed and mixed. The mixture thus obtained in the glass container was agitated in an oil bath at 80° C. for 5 hours, so that a coating liquid E1 was prepared. The coating liquid E1 was diluted with dimethoxyethane so as to have a solid content of 1.0 mass %, which was applied to the outer circumference of the elastic layer of an electro-conductive elastic roller 1 (electro-conductive elastic roller after surface polishing) by ring coating under the following conditions:

Discharge: 0.120 mL/s

Speed at ring part: 85 mm/s

The coating was heated in a hot air circulating oven at 80° C. for 30 minutes, so that a charging roller E1 was made.

[Evaluation 1] Measurement of Modulus of Elasticity of Hardened Film

The coating liquid E1 was diluted with dimethoxyethane, so that a diluted solution having a solid content of 7.0 mass % was prepared. The diluted solution was dropped on an aluminum sheet having a thickness of 100 μm, and a film was formed at a rotational speed of 300 rpm for 2 seconds, with a spin coater (1H-D7, manufactured by Mikasa Co., Ltd.). After drying, the film was heated in a hot air circulating oven at 80° C. for 30 minutes, so that a hardened film was formed. The modulus of elasticity of the hardened film was measured with a physical property tester for surface coating (product name: FISCHER SCOPE H100V, manufactured by Helmut Fischer GmbH). The value when the indenter was pushed in from the surface of an object to be measured at a rate of 0.4 μm/7 s was presumed as the modulus of elasticity. The sample for measurement of the modulus of elasticity was adjusted to have a hardened film thickness of 10 μm or more. In order to obtain a sufficient hardened film thickness, the spin coating may be performed a plurality of times. The measurement results are described in Table 4.

[Evaluation 2] Confirmation of Structure of Formula (1)

Using $^{1}$H-NMR (Apparatus used: JMN-EX400, manufactured by JEOL Ltd.), it was confirmed whether or not the structure of formula (1) is present in the coating liquid E1. More specifically, the bonding resulting from the reaction between the phenolic hydroxyl group in polyvinylphenol and the epoxy group in 3-glycidoxypropyltrimethoxysilane was confirmed. When the coating liquid E1 was used as the measurement sample, however, the $^{1}$H-NMR peak was broadened by polyvinylphenol as polymer, causing difficulty in analysis. In the present evaluation, therefore, the structure of formula (1) was confirmed by a model reaction between p-cresol as a single molecule and 3-glycidoxypropyltrimethoxysilane. The preparation method of the measurement sample is as follows.

Figure 3:
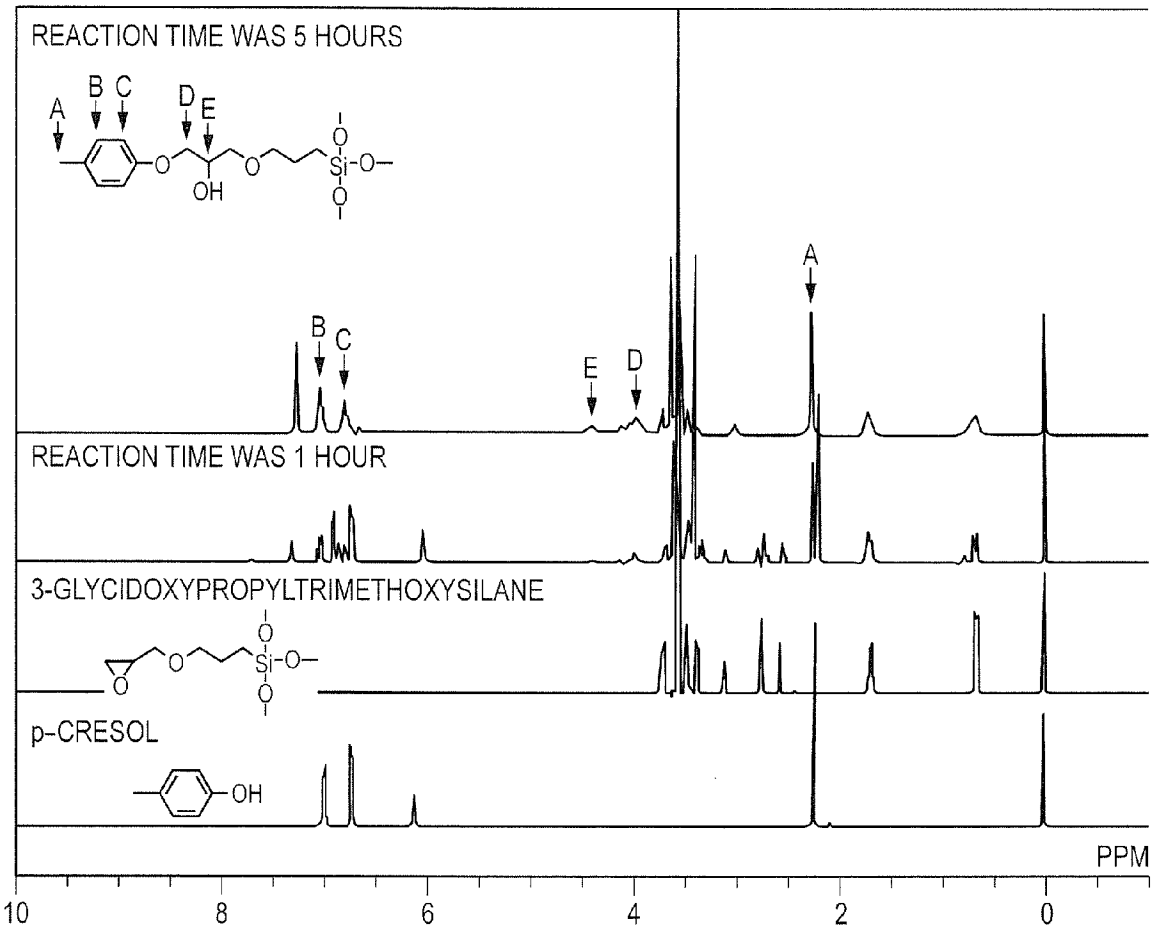
FIG. 3 is a chart illustrating the $^{1}$H-NMR measurement results of a model simulating one example of the surface layer of the charging member of the present invention.

In a 50-mL glass container, 10.0 g of dimethoxyethane (DME), 2.29 g of p-cresol (manufactured by Tokyo Chemical Industry Co., Ltd.), and 5.0 g of 3-glycidoxypropyltrimethoxysilane (EP-1) were placed and mixed. The mixture thus obtained in the glass container was agitated in an oil bath at 80° C. for 5 hours, so that a measurement sample was prepared. The measurement results are described in FIG. 3. In the results of the measurement sample, the peaks of the methyl and the aromatic ring of raw material cresol shifted toward the low magnetic field side (peaks A, B and C), and peaks D and E not present in the raw material appeared. The results indicates that the reaction between the phenolic hydroxyl group in p-cresol and the epoxy group in 3-glycidoxypropyltrimethoxysilane changed the environment of each the protons. Accordingly, it is presumed that the coating liquid E1 made from polyvinylphenol with a structure similar to p-cresol has the structure of formula (1).

[Evaluation 3]

At least a charging roller E1 and an electrophotographic photosensitive member were incorporated in a process cartridge so as to be integrally supported thereby. More specifically, the process cartridge included a charging roller E1 as the charging member 22, a photosensitive member 21, a developing device 24, and a cleaning device 26 in the structure illustrated in FIG. 2, integrally supported by a housing structure.

The charging roller E1 as the charging member 22 was applied with a total load of 1 kg so as to come in contact with an electrophotographic photosensitive member. The process cartridge in the state was left standing under high temperature and high humidity conditions (temperature: 40° C., humidity: 95% RH) for 10 days to prepare a sample or for 30 days to prepare another sample. Each of the samples was taken out from the high temperature and high humidity environment and then left standing under normal temperature and normal humidity (temperature: 25° C., humidity: 50% RH) for 72 hours. After left standing, each of the process cartridges was installed on a laser beam printer (product name: HP COLOR LASERJET CP4525 PRINTER, manufactured by Hewlett Packard) for A4 vertical output, and an image was outputted in the same normal temperature and normal humidity conditions.

From a charging bias applying power source, a voltage of −1140 V was applied to the charging roller E1 (DC charging method), and the surface of photosensitive member was uniformly charged at a prescribed polar potential (dark part potential: −500 V). For the selective deposition of toner (negatively chargeable toner) charged to the same polarity as the charging polarity of the photosensitive member for visualization of a static latent image as a toner image, the developing bias was set at −400 V.

The charging roller E1 had permanent compressive deformation at the contact part with the photosensitive member, so that the discharging gap was enlarged in comparison with a part having no deformation. When the charging potential at the contact part was lower than that of the non-contact part, the contact mark appeared in an image as a black streak. The black streak in the output image obtained was evaluated on the following criteria. The results are described in Table 4.

Rank A: No occurrence of black streak was observed in the image.

Rank B: Slight black streaks were observed, having a length less than 20 mm.

Rank C: Black streaks were observed, having a length of 20 mm or more and less than 50 mm.

Rank D: Black streaks were conspicuous, having a length of 50 mm or more.

(Example 2 to Example 11) Charging Rollers E2 to E11

Dimethoxyethane, polyvinylphenol, and a hydrolysable compound (EP-2 to EP-11) were compounded as described in Table 4, and coating liquids E2 to E11 each were prepared in the same way as in Example 1. Except that the coating liquids E2 to E11 each were used, charging rollers E2 to E11 were made in the same way as in Example 1 for evaluation. The evaluation results are collectively described in Table 4.

(Comparative Example 1) Charging Roller C1

In a 50-mL glass container, 10.0 g of dimethoxyethane and 10.0 g of polyvinylphenol were placed and mixed. The mixture in the glass container was agitated in an oil bath at 80° C. for 5 hours, so that a coating liquid C1 was prepared. Except that the coating liquid C1 was used, a charging roller C1 was made in the same way as in Example 1 for evaluation. The evaluation results are described in Table 4.

(Comparative Example 2) Charging Roller C2

Using tetraethoxysilane (TEOS) instead of 3-glycidoxypropyltrimethoxysilane (EP-1), a coating liquid C2 was prepared in the same way as in Example 1. The weighed values are described in Table 4. Except that the coating liquid C2 was used, a charging roller C2 was made in the same way as in Example 1. The charging roller C2 caused whitening of the surface layer in drying after ring coating, so that evaluations 1 to 3 were not performed.

(Comparative Example 3) Charging Roller C3

Using bisphenol A diglycidyl ether (bPhA) instead of 3-glycidoxypropyltrimethoxysilane (EP-1), a coating liquid C3 was prepared in the same way as in Example 1. The weighed values are described in Table 4. Except that the coating liquid C3 was used, a charging roller C3 was made in the same way as in Example 1 for evaluation. The evaluation results are described in Table 4.

(Example 12 to Example 15, and Comparative Example 4) Charging Rollers E12 to E15, and Charging Roller C4

Dimethoxyethane, polyvinylphenol, and 3-glycidoxypropyltrimethoxysilane (EP-1) were compounded as described in Table 4, and coating liquids E12 to E15 and a coating liquid C4 each were prepared in the same way as in Example 1. Except that the coating liquids E12 to E15 and the coating liquid C4 each were used, charging rollers E12 to E15 and a charging roller C4 were made in the same way as in Example 1. The surface layer of the charging roller C4 was not hardened after heat treatment, so that the evaluations 1 to 3 of the charging roller C4 were not performed. The charging rollers E12 to E15 were evaluated in the same way as in Example 1. The evaluation results are collectively described in Table 4.

(Comparative Example 5) Charging Roller C5

In a 50-mL glass container, 10.45 g of ethanol, 1.28 g of phenyltriethoxysilane (product name: KBE-103, manufactured by Shin-Etsu Chemical Co., Ltd.), 9.89 g of hexyltrimethoxysilane (product name: KBM-3063, manufactured by Shin-Etsu Chemical Co., Ltd.), and 4.32 g of water were placed and mixed. The mixture thus obtained in the glass container was heated to reflux in an oil bath at 120° C. for 20 hours, so that a coating liquid C5 was prepared. The coating liquid C5 was diluted with a mixed solvent of 10 g of 2-butanol/65 g of ethanol so as to have a solid content of 1.0 mass %. Except that the coating liquid was then hardened by standing in a hot air circulating oven at a temperature of 160° C. for 2 hours instead of at a temperature of 80° C. for 30 minutes, the surface layer was formed in the same way as in Example 1, so that a charging roller C5 was made. The charging roller C5 was evaluated in the same way as in Example 1. The evaluation results are described in Table 4.

(Example 16 to Example 21) Charging Rollers E16 to E21

Dimethoxyethane, a polyvinylphenol polymer (PVP-2 to PVP-7), and 3-glycidoxypropyltrimethoxysilane (EP-1) were compounded as described in Table 4, and coating liquids E16 to E21 each were prepared in the same way as in Example 1. Except that the coating liquids E16 to E21 each were used, charging rollers E16 to E21 were made in the same way as in Example 1. The charging rollers E16 to E21 were evaluated as Example 16 to Example 21. The evaluation results are collectively described in Table 4.

(Comparative Example 6) Charging Roller C6

Using polystyrene (PS, manufactured by Sigma-Aldrich) instead of polyvinylphenol (PVP-1, manufactured by Sigma-Aldrich), a coating liquid C6 was prepared in the same way as in Example 1. The weighed values are described in Table 4. Except that the coating liquid C6 was used, a charging roller C6 was made in the same way as in Example 1 for evaluation as Comparative Example 6. The evaluation results are described in Table 4.

TABLE 2-1

List of polymers used

| Abbreviation | Compound | Structure | Manufacturer | Product name | Molecular weight | PVP ratio |
|---|---|---|---|---|---|---|
| PVP-1 | Poly (4-vinylphenol) (=PVP) | 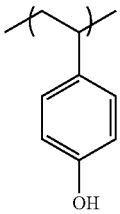 | Sigma-Aldrich Corporation | — | ~25000 | 100 mol % |
| PVP-2 | PVP-polystyrene (=PS) copolymer | 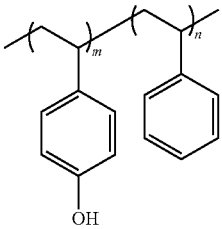 | Maruzen Petrochemical Co., Ltd. | MARUKA LINKER CST-70 | 3000-5000 | 70 mol % |

TABLE 2-1-continued

List of polymers used

| Abbreviation | Compound | Structure | Manufacturer | Product name | Molecular weight | PVP ratio |
|---|---|---|---|---|---|---|
| PVP-3 | PVP-PS copolymer | 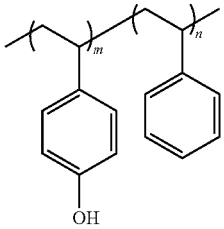 | Maruzen Petrochemical Co., Ltd. | MARUKA LINKER CST-15 | 3000-5000 | 15 mol % |
| PVP-4 | PVP-polymethyl-methacrylate (=PMMA) copolymer | 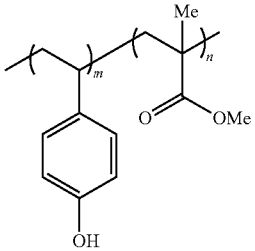 | Maruzen Petrochemical Co., Ltd. | MARUKA LINKER CST-50 | 8000-12000 | 50 mol % |
| PVP-5 | PVP | 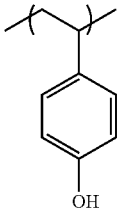 | Maruzen Petrochemical Co., Ltd. | MARUKA LINKER MH-2P | 19800-24200 | 100 mol % |
| PVP-6 | PVP | 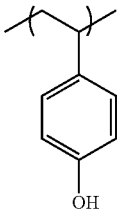 | Maruzen Petrochemical Co., Ltd. | MARUKA LINKER MS-2P | 4000-6000 | 100 mol % |
| PVP-7 | PVP | 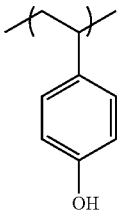 | Maruzen Petrochemical Co., Ltd. | MARUKA LINKER MS-1P | 1600-2400 | 100 mol % |
| PS | Polystyrene (=PS) | 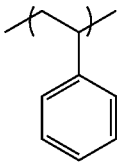 | Sigma-Aldrich Corporation | — | 35000 | 0 mol % |
| bPhA | Bisphenol A diglycidyl ether | 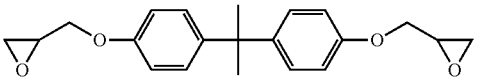 | Tokyo Chemical Industry Co., Ltd. | — | 340 | 0 mol % |

TABLE 3

List of hydrolysable compounds used

| Abbreviation | Name | Structure | Manufacturer | Product name |
|---|---|---|---|---|
| EP-1 | 3-glycidoxypropyl-trimethoxysilane | $(CH_2)-O-(CH_2)_3-Si(OMe)_3$ | Shin-Etsu Chemical Co., Ltd. | KBM-403 |
| EP-2 | 3-glycidoxypropyl-triethoxysilane | $(CH_2)-O-(CH_2)_3-Si(OEt)_3$ | Shin-Etsu Chemical Co., Ltd. | KBE-403 |
| EP-3 | 3-glycidoxypropyl-methyldimethoxysilane | $(CH_2)-O-(CH_2)_3-Si(OMe)_2$ | Shin-Etsu Chemical Co., Ltd. | KBM-402 |
| EP-4 | 4-(trimethoxysilyl) butane-1,2-epoxide | $(CH_2)_2-Si(OMe)_3$ | SiKEMIA | — |
| EP-5 | 4-(triethoxysilyl) butane-1,2-epoxide | $(CH_2)_2-Si(OEt)_3$ | SiKEMIA | — |
| EP-6 | 5,6-epoxyhexyl-triethoxysilane | $(CH_2)_4-Si(OEt)_3$ | Gelest, Inc. | — |
| EP-7 | 8-oxysilane-2-yloctyltrimethoxysilane | $(CH_2)_8-Si(OMe)_3$ | SiKEMIA | — |
| EP-8 | 8-oxysilane-2-yloctyltriethoxysilane | $(CH_2)_8-Si(OEt)_3$ | SiKEMIA | — |
| EP-9 | 2-(3,4-epoxycyclohexyl) ethyltrimethoxysilane | $(CH_2)_2-Si(OMe)_3$ | Shin-Etsu Chemical Co., Ltd. | KBM303 |
| EP-10 | 2-(3,4-epoxycyclohexyl) ethyltriethoxysilane | $(CH_2)_2-Si(OEt)_3$ | Gelest, Inc. | — |
| EP-11 | 2-(3,4-epoxycyclohexyl) ethylmethyl-diethoxysilane | $(CH_2)_2-Si(OEt)_2$ | Gelest, Inc. | — |
| TEOS | tetrathoxysilane | $Si(OEt)_4$ | Kishida Chemical Co., Ltd | — |
| Ph | Phenyltriethoxysilane | $Si(OEt)_3$ | Shin-Etsu Chemical Co., Ltd. | KBE103 |
| He | Hexytrimethoxysilane | $Si(OMe)_3$ | Shin-Etsu Chemical Co., Ltd. | KBM3063 |

TABLE 4

| | Polymer | | Silane | | DME | | | Aluminum sheet film evaluation | | Black streak image rank | |
|---|---|---|---|---|---|---|---|---|---|---|---|
| | Type | Amount used [g] | Type | Amount used [g] | Amount used [g] | Polymer/silane | Film formability | Film thickness [μm] | Modulus of elasticity [MPa] | 10 Days | 30 Days |
| Example 1 | PVP-1 | 5 | EP-1 | 5 | 10 | 50/50 | good | 11 | 4683 | A | B |
| Example 2 | | 5 | EP-2 | 5 | 10 | | good | 10 | 4522 | A | B |
| Example 3 | | 5 | EP-3 | 5 | 10 | | good | 10 | 4423 | A | B |
| Example 4 | | 5 | EP-4 | 5 | 10 | | good | 11 | 4642 | A | B |
| Example 5 | | 5 | EP-5 | 5 | 10 | | good | 11 | 4566 | A | B |
| Example 6 | | 5 | EP-6 | 5 | 10 | | good | 12 | 4415 | A | B |
| Example 7 | | 5 | EP-7 | 5 | 10 | | good | 11 | 4439 | A | B |
| Example 8 | | 5 | EP-8 | 5 | 10 | | good | 11 | 4345 | A | B |
| Example 9 | | 5 | EP-9 | 5 | 10 | | good | 12 | 4751 | A | B |
| Example 10 | | 5 | EP-10 | 5 | 10 | | good | 11 | 4695 | A | B |
| Example 11 | | 5 | EP-11 | 5 | 10 | | good | 10 | 4515 | A | B |
| Comparative Example 1 | PVP-1 | 10 | — | — | 10 | 100/0 | good | 13 | 3985 | C | D |
| Comparative Example 2 | PVP-1 | 5 | TEOS | 5 | 10 | 50/50 | poor | —* | —* | —* | —* |
| Comparative Example 3 | PVP-1 | 5 | bPhA | 5 | 10 | 50/50 | good | 13 | 5631 | C | D |
| Example 12 | PVP-1 | 9 | EP-1 | 1 | 10 | 90/10 | good | 12 | 4426 | B | B |
| Example 13 | | 7 | | 3 | 10 | 70/30 | good | 12 | 4555 | A | B |
| Example 14 | | 3 | | 7 | 10 | 30/70 | good | 11 | 4750 | A | B |
| Example 15 | | 1 | | 9 | 10 | 10/90 | good | 11 | 4667 | B | B |
| Comparative Example 4 | PVP-1 | 0.5 | EP-1 | 9.5 | 10 | 5/95 | poor | —* | —* | —* | —* |
| Comparative Example 5 | — | — | Ph, He | 10 | 10 | 0/100 | good | 11 | 3855 | C | D |
| Example 16 | PVP-2 | 5 | EP-1 | 5 | 10 | 50/50 | good | 12 | 4158 | B | B |
| Example 17 | PVP-3 | 5 | | 5 | 10 | | good | 12 | 3965 | B | B |
| Example 18 | PVP-4 | 5 | | 5 | 10 | | good | 11 | 3987 | B | B |
| Example 19 | PVP-5 | 5 | | 5 | 10 | | good | 10 | 4582 | A | B |
| Example 20 | PVP-6 | 5 | | 5 | 10 | | good | 11 | 4623 | A | B |
| Example 21 | PVP-7 | 5 | | 5 | 10 | | good | 10 | 4766 | A | B |
| Comparative Example 6 | PS | 5 | EP-1 | 5 | 10 | 50/50 | good | 12 | 3878 | C | D |

*Unexamined due to poor film formability

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-249075, filed Dec. 9, 2014, which is hereby incorporated by reference herein in its entirety.

What is claimed is:

1. A charging member comprising:

a support, and a surface layer on the support;

wherein, the surface layer comprises a polymer compound having a structural unit represented by the following formula (1):

Formula (1)

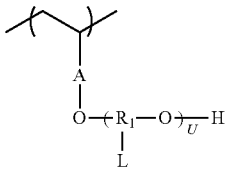

wherein A represents an aromatic cyclic hydrocarbon group; $R_1$ represents any one of the following formulae (2) to (5); L represents a polysiloxane having at least one of an $SiO_{3/2}$ unit (T) and an $SiO_{2/2}$ unit (D); and U represents an integer of 1 or more, with the proviso that U is integer of 2 or more, a plurality of $R_1$ represent any one of the following formulae (2) to (5) respectively;

Formula (2)

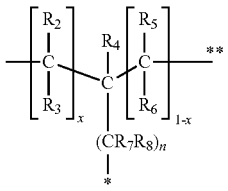

-continued

Formula (3)

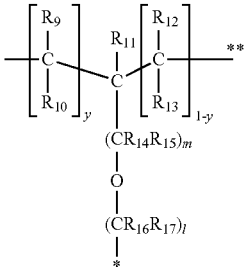

Formula (4)

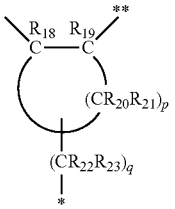

Formula (5)

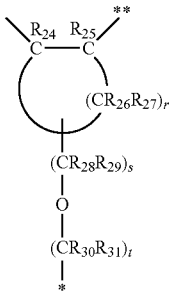

wherein $R_2$ to $R_6$, $R_9$ to $R_{13}$, $R_{18}$, $R_{19}$, $R_{24}$ and $R_{25}$ each independently represent a hydrogen atom, an alkyl group having 1 to 4 carbon atoms, a hydroxyl group, a carboxyl group or an amino group;

$R_7$, $R_8$, $R_{14}$ to $R_{17}$, $R_{22}$, $R_{23}$, and $R_{28}$ to $R_{31}$ each independently represent a hydrogen atom or an alkyl group having 1 to 4 carbon atoms;

$R_{20}$, $R_{21}$, $R_{26}$ and $R_{27}$ each independently represent a hydrogen atom, an alkoxy group or alkyl group having 1 to 4 carbon atoms;

n, m, l, q, s and t each independently represent an integer of 1 to 8, and p and r each independently represent an integer of 4 to 12;

x and y each independently represent 0 or 1;

the symbol "*" represents the binding site with a silicon atom in a polysiloxane represented by L in the formula (1); and the symbol "**" represents the binding site with an oxygen atom in a unit represented by —($R_1$(L)-O)— in the formula (1).

2. The charging member according to claim 1, $R_1$ is any one of the groups represented by the following formulae (6) to (9), with the proviso that U in the formula (1) is an integer of 2 or more, a plurality of $R_1$ independently are any one of the groups represented by the following formulae (6) to (9):

Formula (6)

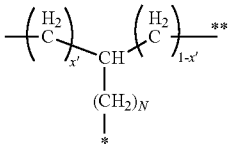

-continued

Formula (7)

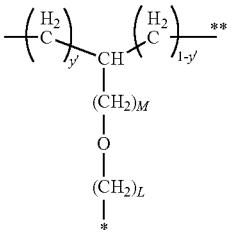

Formula (8)

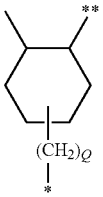

Formula (9)

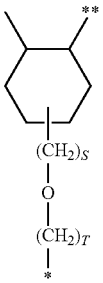

wherein N, M, L, Q, S and T each independently represent an integer of 1 to 8; x' and y' each independently represent 0 or 1; the symbol * represents the binding site with a silicon atom in polysiloxane represented by L in the formula (1); and the symbol ** represents the binding site with an oxygen atom in the unit represented by —($R_1$(L)-O)— in the formula (1).

3. The charging member according to claim 1, wherein the polymer compound is a reaction product of:

a compound having a structure represented by the following formula (10); and at least one of a hydrolysable compound represented by the following formula (11) and a hydrolysable compound represented by the following formula (12):

Formula (10)

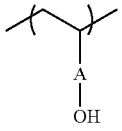

Formula (11)

Formula (12)

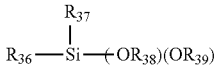

wherein A represents an aromatic cyclic hydrocarbon group; $R_{32}$ and $R_{36}$ represent any one of the following formulae (13) to (16) having an epoxy group; $R_{33}$ to $R_{35}$, $R_{38}$ and $R_{39}$ each independently represent a hydrocarbon group; and $R_{37}$ represents a saturated or unsaturated hydrocarbon group;

Formula (13)

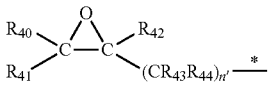

Formula (14)

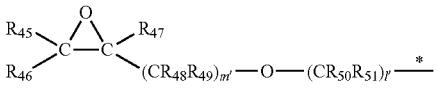

Formula (15)

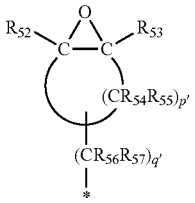

Formula (16)

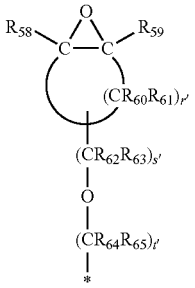

wherein $R_{40}$ to $R_{42}$, $R_{45}$ to $R_{47}$, $R_{52}$, $R_{53}$, $R_{58}$ and $R_{59}$ each independently represent a hydrogen atom, an alkyl group having 1 to 4 carbon atoms, a hydroxyl group, a carboxyl group or an amino group;

$R_{43}$, $R_{44}$, $R_{48}$ to $R_{51}$, $R_{56}$, $R_{57}$, and $R_{62}$ to $R_{65}$ each independently represent a hydrogen atom or an alkyl group having 1 to 4 carbon atoms;

$R_{54}$, $R_{55}$, $R_{60}$ and $R_{61}$ each independently represent a hydrogen atom, an alkoxy group having 1 to 4 carbon atoms or an alkyl group having 1 to 4 carbon atoms;

n', m', l', q', s' and t' each independently represent an integer of 1 to 8;

p' and r' each independently represent an integer of 4 to 12; and the symbol "*" represents the binding site with a silicon atom in the formula (11) or the formula (12).

4. A process cartridge which is detachably mountable to a body of an electrophotographic apparatus, comprising an electrophotographic photosensitive member and a charging member for charging the surface of the electrophotographic photosensitive member, wherein the charging member comprises a support and a surface layer on the support, and the surface layer comprises a polymer compound having a structural unit represented by the following formula (1):

Formula (1)

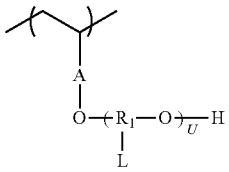

wherein A represents an aromatic cyclic hydrocarbon group; $R_1$ represents any one of the following Formulae (2) to (5); L represents a polysiloxane having at least one of an $SiO_{3/2}$ unit (T) and an $SiO_{2/2}$ unit (D); and U represents an integer of 1 or more, with the proviso that U is an integer of 2 or more, a plurality of $R_1$ independently represent any one of the following Formulae (2) to (5);

Formula (2)

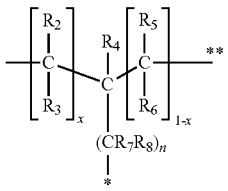

Formula (3)

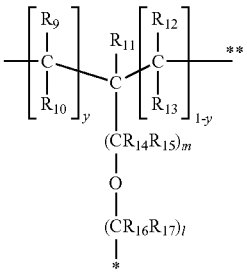

Formula (4)

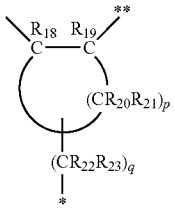

Formula (5)

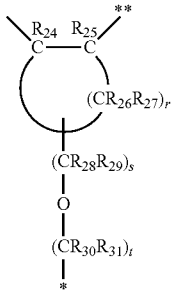

wherein $R_2$ to $R_6$, $R_9$ to $R_{13}$, $R_{18}$, $R_{19}$, $R_{24}$ and $R_{25}$ each independently represent a hydrogen atom, an alkyl group having 1 to 4 carbon atoms, a hydroxyl group, a carboxyl group or an amino group;

$R_7$, $R_8$, $R_{14}$ to $R_{17}$, $R_{22}$, $R_{23}$, and $R_{28}$ to $R_{31}$ each independently represent a hydrogen atom or an alkyl group having 1 to 4 carbon atoms;

$R_{20}$, $R_{21}$, $R_{26}$ and $R_{27}$ each independently represent a hydrogen atom, an alkoxy group or alkyl group having 1 to 4 carbon atoms;

n, m, l, q, s and t each independently represent an integer of 1 to 8; p and r each independently represent an integer of 4 to 12;

x and y each independently represent 0 or 1;

the symbol "*" represents the binding site with a silicon atom in a polysiloxane represented by L in the formula (1); and the symbol "**" represents the binding site with an oxygen atom in a unit represented by —($R_1$ (L)-O)— in the formula (1).

5. An electrophotographic apparatus comprising:

an electrophotographic photosensitive member and a charging member for charging the surface of the electrophotographic photosensitive member, wherein the charging member comprises a support and a surface layer on the support, and the surface layer comprises a polymer compound having a structural unit represented by the following formula (1):

Formula (1)

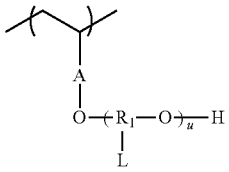

wherein A represents an aromatic cyclic hydrocarbon group; $R_1$ represents any one of the following formulae (2) to (5); L represents a polysiloxane having at least one of an $SiO_{3/2}$ unit (T) and an $SiO_{2/2}$ unit (D); and U represents an integer of 1 or more, with the proviso that U is an integer of 2 or more, a plurality of $R_1$ independently represent any one of the following Formulae (2) to (5);

Formula (2)

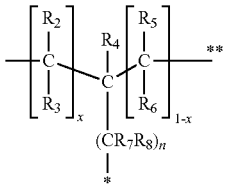

Formula (3)

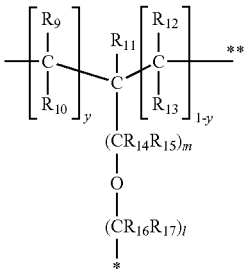

-continued

Formula (4)

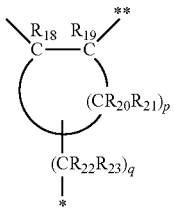

Formula (5)

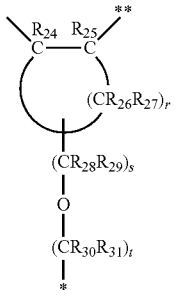

wherein $R_2$ to $R_6$, $R_9$ to $R_{13}$, $R_{18}$, $R_{19}$, $R_{24}$ and $R_{25}$ each independently represent a hydrogen atom, an alkyl group having 1 to 4 carbon atoms, a hydroxyl group, a carboxyl group or an amino group;

$R_7$, $R_8$, $R_{14}$ to $R_{17}$, $R_{22}$, $R_{23}$, and $R_{28}$ to $R_{31}$ each independently represent a hydrogen atom or an alkyl group having 1 to 4 carbon atoms;

$R_{20}$, $R_{21}$, $R_{26}$ and $R_{27}$ each independently represent a hydrogen atom, an alkoxy group or alkyl group having 1 to 4 carbon atoms;

n, m, l, q, s and t each independently represent an integer of 1 to 8; p and r each independently represent an integer of 4 to 12;

x and y each independently represent 0 or 1;

the symbol "*" represents the binding site with a silicon atom in a polysiloxane represented by L in the formula (1); and the symbol "**" represents the binding site with an oxygen atom in a unit represented by —($R_1$ (L)-O)— in the formula (1).

* * * * *